United States Patent [19]

Wilde et al.

[11] 4,357,135

[45] Nov. 2, 1982

[54] METHOD AND SYSTEM FOR CONTROLLING MULTI-ZONE REHEATING FURNACES

[75] Inventors: James D. Wilde, Bay Village; Rolland L. Hoffman, Brecksville, both of Ohio

[73] Assignee: North American Mfg. Company, Cleveland, Ohio

[21] Appl. No.: 271,037

[22] Filed: Jun. 5, 1981

[51] Int. Cl.[3] ..... F27D 3/00

[52] U.S. Cl. ..... 432/11; 432/18; 432/37; 432/54; 266/80

[58] Field of Search ..... 432/11, 18, 36, 37, 432/49, 54; 266/78, 80

[56] References Cited

U.S. PATENT DOCUMENTS

| | | | |
|---|---|---|---|
| 2,205,182 | 6/1940 | Whitten | 432/49 |
| 2,523,644 | 9/1950 | Bloom | 263/43 |
| 3,022,056 | 2/1962 | Dailey | 263/6 |
| 3,604,695 | 9/1971 | Steeper | 266/5 T |
| 3,627,857 | 6/1971 | Matuno et al. | 432/11 |
| 3,689,042 | 9/1972 | Pere et al. | 263/40 R |
| 3,868,094 | 2/1975 | Hovis | 266/5 T |
| 3,969,069 | 7/1976 | Knaak | 432/25 |
| 4,087,238 | 5/1978 | Seigel | 432/18 |
| 4,108,594 | 8/1978 | Venetta et al. | 432/24 |
| 4,257,767 | 3/1981 | Price | 266/80 |

*Primary Examiner*—John J. Camby

*Attorney, Agent, or Firm*—Meyer, Tilberry & Body

[57] ABSTRACT

A method and system is provided for controlling a reheating furnace having entrance and discharge ends, a preheating zone at the entrance end, and heating and soaking zones sequentially adjacent the preheating zone in the direction toward the discharge end, and an exhaust gas flue at the entrance end. The method and control system provides for obtaining an optimum temperature profile through the preheating and heating zones with minimum fuel consumption in connection with operation of the preheating zone by controlling the fuel supply to the preheating zone in accordance with the rate or quantity of fuel flow to the heating zone and the temperature of the exhaust gas from the furnace.

10 Claims, 4 Drawing Figures

METHOD AND SYSTEM FOR CONTROLLING MULTI-ZONE REHEATING FURNACES

BACKGROUND OF THE INVENTION

This invention relates to the art of multi-zone reheat furnaces and, more particularly, to a method and control system for achieving energy conservation in connection with the use of such reheat furnaces.

The reheating of workpieces such as steel billets, blooms or slabs is often achieved in a multi-zone reheat furnace having sequentially arranged preheating, heating and soaking zones through which the workpieces are advanced to heat the workpieces to a desired process temperature appropriate for working the workpieces, such as for example by hot rolling or forging. It is of course well known that the preheating and heating zones of such furnaces are fired to achieve heating of the workpieces passing therethrough at a given throughput rate so that the workpieces are elevated to the soaking temperature when they enter the soaking zone. With respect to the given throughput rate, it is of course desirable to achieve such heating of the workpieces with minimum fuel consumption in connection with the firing of the preheating and heating zones. At the same time, it is important that the workpieces reach the soaking temperature no later than the time of entrance into the soaking zone to assure that the workpieces are thoroughly heated when they are discharged from the furnace. In this respect, the process temperature is a critical factor in connection with obtaining an acceptable product when a workpiece is rolled, forged or otherwise worked following discharge from the furnace. Accordingly, it has been the practice heretofore with either manual or automatic control systems for such reheat furnaces to heat the workpieces during movement thereof through the preheating and heating zones so that the soaking temperature is reached early in the heating zone and is substantially reached in the preheating zone. As a result of such practice, the workpieces are held at or near the process temperature for longer periods than desired, and this causes the production of excessive scale or metallic oxides which can result in the loss of a saleable end product. Furthermore, such quick elevating of the workpiece temperature requires a high temperature profile across the preheating zone and, accordingly, excessive consumption of fuel in connection with firing the latter and excessive thermal loss as a result of high waste or exhaust gas temperatures.

Manual control of the temperatures in the preheating and heating zones of a reheat furnace, to be effective, requires operator experience together with a high degree of attentiveness to conditions within the furnace. In the absence of such experience and attentiveness, the work in the furnace can be severely damaged. In any event, manual control based on existing furnace or workpiece operating or condition characteristics is not efficient with respect to fuel consumption. In this respect, the operator is often personally responsible for the condition of the workpieces exiting from the furnace and, accordingly, will maintain higher than necessary temperatures in the furnace to assure thorough heating of the workpieces when they exit from the furnace. A variety of automatic control systems having been devised heretofore in an effort to increase the efficiency in operation of reheat furnaces with respect to fuel consumption and product quality, but these systems, as a result of instrumentation used and/or the furnace or workpiece conditions to which they are designed to respond, do not enable achieving a temperature profile across the preheating and heating zones which minimizes fuel consumption and thermal losses while assuring that workpieces are maintained in the furnace at the process temperature for a minimum amount of time during continuous furnace operation. Furthermore, such previous systems are slow in response to either an increase or a decrease in throughput rate, thus limiting the operating efficiency of the system and, additionally, the ability to achieve smoothness and accuracy with respect to varying burner operating functions in connection with varying throughput rates.

SUMMARY OF THE INVENTION

In accordance with the present invention, a method and system are provided for controlling a multi-zone reheat furnace which enables achieving a lower furnace temperature profile across the preheating and heating zones than heretofore possible in connection with a given throughput rate, while providing for workpieces being heated to be maintained in the furnace at the desired process temperature for a minimum period of time. Furthermore, the method and system according to the present invention provide for achieving the latter with a substantially lower temperature profile across the preheat zone than heretofore possible, whereby a reduction in the loss of product as the result of scaling is realized together with a reduction in thermal losses and a reduction in fuel consumption per unit weight of work through the furnace. The invention is applicable to a variety of direct fired, multi-zone, continuous reheating furnaces such as, for example, walking beam, roller hearth, rotary hearth, bogey and pusher type furnaces, in which a number of heating zones follow one another in the direction between the input and discharge ends of the furnace, and in which the products of combustion are exhausted adjacent the input end of the furnace. The foregoing operating characteristics and advantages realized in accordance with the invention are achieved by employing the exhaust gas temperature and the rate of fuel flow to the burner in the heating zone as control function indicators upon which furnace control is based, and by controlling the fuel flow rate to the burner in the preheating zone in accordance with a control signal derived by comparing signals respectively representative of the exhaust gas temperature and the rate of fuel flow to the heating zone of the furnace.

It is of course well known that the exhaust gases in a reheat furnace of the foregoing character are the result of the counterflow of hot gases from the soaking and heating zones to the preheating zone and thence to the exhaust flue. It will be appreciated, therefore, that the temperature of exhaust gases in or near the entrance to the exhaust flue represents the location in the furnace wherein the quickest temperature change will occur upon increasing or decreasing the throughput rate from that at which the furnace is operating at any given time. In this respect, a decrease in throughput rate will result in a substantially immediate increase in the exhaust gas temperature due to the fact that the exhaust gas temperature is cumulative from the preheating, heating and soaking zones. Likewise, an increase in throughput rate will result in a substantially immediate decrease in the exhaust gas temperature as a result of the exhaust gases sweeping across colder metal entering the furnace. Accordingly, using a signal representative of exhaust gas temperature as a control signal enables minimizing response time in connection with controlling a furnace in accordance with the present invention. Further, it has been established that a given rate of fuel input to the heating zone is indicative of a corresponding throughput rate for the furnace and that for such given throughput rate and the corresponding rate of fuel input to the heating zone, there is a positive relationship between the exhaust gas temperature and the rate of fuel input to the heating zone. By employing these relationships in a control system according to the present invention, the temperature profile through the preheating and heating zones of the furnace is substantially reduced while providing a temperature profile which enables the work being heated to be maintained at the soaking temperature for a minimum period of time. The lower temperature profile reduces the fuel consumption, especially with respect to firing of the preheating zone, and enables maintaining the exhaust gas temperature at a minimum. Reduction of the temperature profile further enables a reduction in the loss of product to scaling, and minimizing the exhaust gas temperature results in a reduction in thermal loss and thus an increase in thermal efficiency within the furnace. Moreover, response time in connection with a change in throughput rate is minimized, and smoothness and accuracy with respect to changes in burner operation are achieved in response to a change in throughput rate. All of these advantages are achieved in connection with any given throughput rate for the furnace.

It is accordingly an outstanding object of the present invention to provide an improved method and system for controlling a multi-zone reheat furnace.

Another object is the provision of a method and control system for a multi-zone reheat furnace which enables a more efficient and economical operation thereof than heretofore possible.

Yet another object is the provision of a method and system for controlling a multi-zone reheat furnace so as to provide a furnace temperature profile which, in connection with a given throughput rate, enables maintaining a workpiece being heated at the process temperature therein for a minimum period of time.

A further object is the provision of a method and system for controlling a multi-zone reheat furnace in a manner which optimizes burner fuel consumption per unit weight of work being processed through the furnace.

Still a further object is the provision of a method and system for controlling a multi-zone reheat furnace in a manner which enables optimizing the efficiency of operation of the furnace with respect to fuel consumption and product quality with respect to any given throughput rate for the furnace.

Still a further object is the provision of a method and system for controlling a multi-zone reheat furnace in a manner which minimizes response time with respect to a change in the throughput rate for the furnace and provides improved accuracy and smoothness with respect to operation of furnace components in response to a change in throughput rate.

Still another object is the provision of a method and system for controlling a multi-zone reheat furnace using the temperature of the exhaust gases of the furnace as a control function indicator, and which method enables minimizing the exhaust gas temperature and thus thermal loss for any given throughout rate.

Yet a further object is the provision of a method and system for controlling a multi-zone reheat furnace so as to adjust the rate of fuel flow to the preheating zone in accordance with a control signal derived from signals representative of the exhaust gas temperature and the rate of fuel flow to the heating zone of the furnace.

BRIEF DESCRIPTION OF THE DRAWINGS

The foregoing objects, and others, will in part be obvious and in part pointed out more fully hereinafter in conjunction with the written description of an embodiment of the invention illustrated in the accompanying drawing in which:

FIG. 1 is a schematic illustration of a control system according to the present invention in association with a three-zone pusher type reheat furnace;

DESCRIPTION OF A PREFERRED EMBODIMENT

Figure 4:
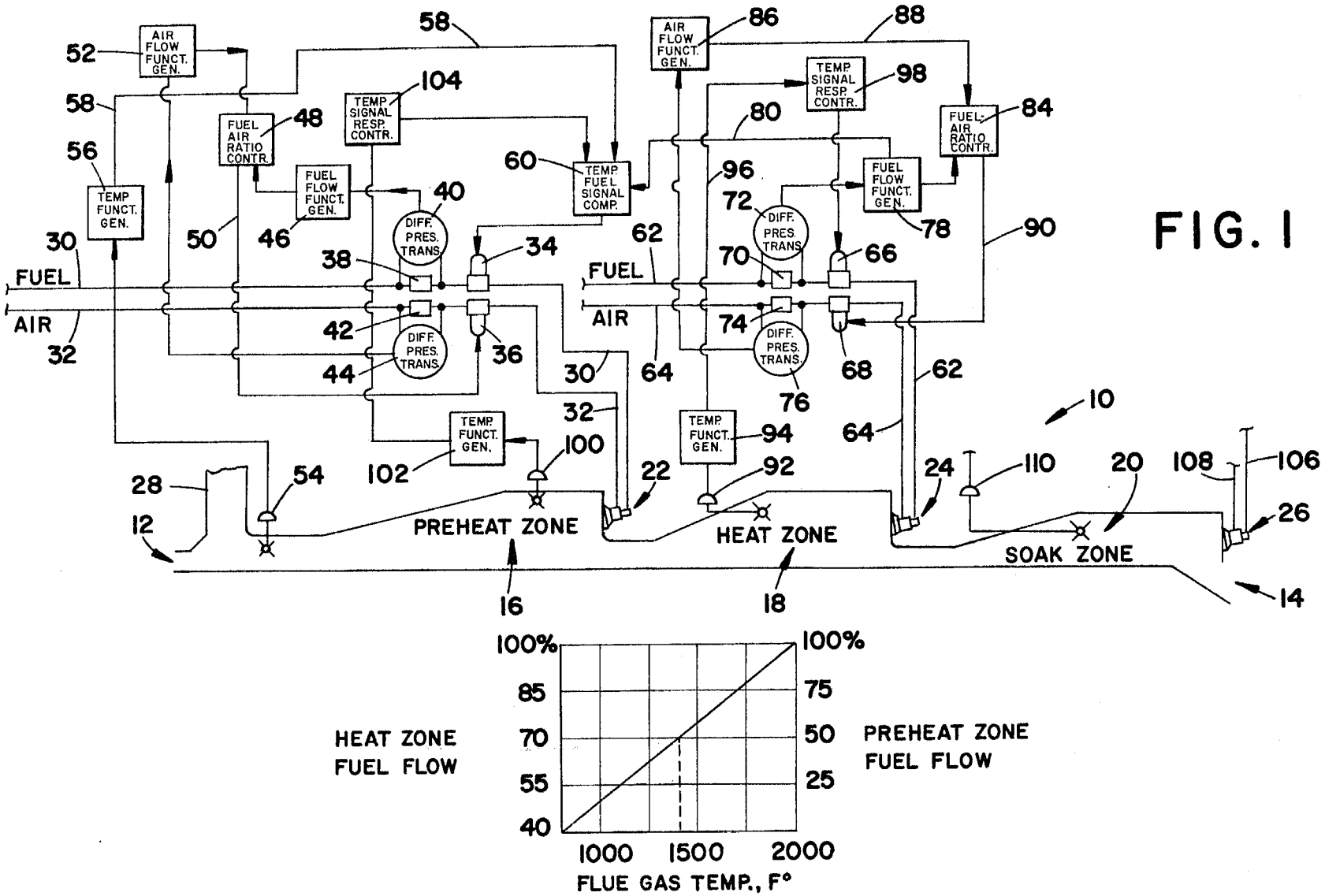

With reference now to the accompanying drawings wherein the showings are for the purpose of illustrating an embodiment of the invention only and not for the purpose of limiting the invention, FIG. 1 schematically illustrates a three zone reheat furnace 10 for the treatment of workpieces pushed through the furnace from input end 12 toward output end 14 thereof. The zones through which the workpieces are progressively pushed include a preheat zone 16, a heat zone 18 and a soak zone 20. Generally, each zone is provided with a plurality of burners, such being represented in FIG. 1 by burners 22, 24 and 26 for zones 16, 18 and 20, respectively, and the furnace includes an exhaust stack or flue 28 adjacent entrance end 12 thereof. It is of course well known that exhaust gases flow through the furnace counter to the direction of workpiece advancement therethrough and are cumulative in the direction from soak zone 20 through heat zone 18 and charge zone 16 to the exhaust flue. While a three zone furnace is illustrated and the invention will be described in conjunction therewith, it will be appreciated that the invention is applicable to other multi-zone reheat furnaces. In this respect, for example, a five zone reheat furnace having preheating and heating zones respectively below 16 and 18 of furnace 10 would be provided with a control system for the lower zones which would be a mirror image of the system illustrated in FIG. 1 and to be described in detail hereinafter.

Burner 22 for preheat zone 16 is provided with fuel and air lines 30 and 32, respectively, each connected to a corresponding supply source, not shown. In the embodiment disclosed the fuel is gas, but it will be appreciated that the method and system are applicable to other fuels such as oil for example. The flow of fuel and air to burner 22 is through a fuel flow control valve 34 in line 30 and an air flow control valve 36 in line 32, and each of the lines 30 and 32 is provided with corresponding flow measuring instruments. In this respect, fuel flow line 30 is provided with an orifice plate 38 and a differential pressure transmitter 40 connected thereacross, and air flow line 32 is provided with an orifice plate 42 and a differential pressure transmitter 44 connected thereacross. Pressure transmitter 40 transmits a pressure signal to a fuel flow function generator 46 which in turn transmits a signal representative of fuel flow rate through line 30 to a fuel-air flow ratio controller 48 having a control signal output through line 50 for controlling air flow valve 36 in the manner and for the purpose described hereinafter. Pressure transmitter 44 transmits an air pressure signal to a corresponding air flow function generator 52 which transmits a signal representative of air flow rate through line 32 to fuel-air ratio controller 48. A temperature sensor 54, such as a thermocouple, for example, is located in the throat of furnace 10 adjacent entrance end 12 and the entrance end of exhaust flue 28 to sense the exhaust gas temperature. While shown in the throat of the furnace, it will be appreciated that the temperature sensor can be provided in exhaust flue 28. Thermocouple 54 transmits a signal to a corresponding temperature function generator 56 which transmits a signal representative of exhaust gas temperature through line 58 to a temperature-fuel flow signal comparator 60 which is operable as described hereinafter to transmit an output signal to fuel flow control valve 34 for controlling the latter valve.

Burner 24 in heat zone 18 is provided with fuel and air supply lines 62 and 64, respectively, each connected to a corresponding supply source source, not shown. The flow of fuel through line 62 to burner 24 is controlled by a fuel flow control valve 66, and the flow of air through line 64 to the burner is controlled by an air flow control valve 68. In a manner similar to that described hereinabove with regard to flow lines 30 and 32, each of the lines 62 and 64 is provided with corresponding flow measuring instruments including an orifice plate 70 and differential pressure transmitter 72 for fuel line 62, and an orifice plate 74 and differential pressure transmitter 76 for air flow line 64. Differential pressure transmitter 72 transmits a pressure signal to a corresponding fuel flow function generator 78 which transmits a control signal representative of fuel flow rate through line 80 to temperature-fuel flow comparator 60, for the purpose set forth hereinafter. Function generator 78 also transmits the fuel flow rate signal through line 82 to a fuel-air ratio controller 84. Differential pressure transmitter 76 transmits a pressure signal to a corresponding air flow function generator 86 which transmits a signal representative of air flow rate through line 88 to fuel-air ratio controller 84. Fuel-air ratio controller 84 has a control signal output through line 90 for controlling air flow control valve 68 in the manner and for the purpose set forth hereinafter. Heat zone 18 is provided with a temperature sensor 92, such as a thermocouple, for sensing the temperature in the heating zone, and thermocouple 92 transmits a signal to a temperature function generator 94 having an output signal through line 96 which is representative of the temperature in heat zone 18. The latter signal is transmitted to a temperature signal responsive controller 98 having an output signal to fuel flow control valve 66 for controlling the latter.

As mentioned hereinabove, it has been established that for a given throughput rate for the furnace there is a corresponding fuel flow rate for burner 24 in heat zone 18, and this flow rate will provide a desired temperature profile across heat zone 18 for the given throughput rate. With this in mind, the desired temperature at a location along heat zone 18 for the given throughput rate is known from the temperature profile curve for the given throughput rate and can be used to control the rate of fuel supply to burner 24. In this respect, it will be appreciated that the temperature in heat zone 18 is sensed by thermocouple 92 and that a signal representative of the temperature is transmitted from temperature function generator 94 to temperature signal responsive controller 98 which in turn controls adjustment of fuel flow control valve 66 to achieve the appropriate fuel flow rate to burner 24. The fuel flow rate signal from pressure transmitter 72 is converted in function generator 78 to a signal representative of fuel flow rate and the latter is transmitted through line 82 to fuel-air ratio controller 84 which, as explained hereinabove, also receives a signal from air flow function generator 86 through line 88 and which signal is representative of air flow rate through line 64. For a given fuel flow rate, there is of course a corresponding air flow rate to provide the proper fuel-air ratio for burner 24, and fuel-air ratio controller 84 is operable in response to the fuel and air flow rate signals received therein to produce an output control signal through line 90 which is operable to adjust air flow control valve 68 to provide the appropriate air flow rate for a given fuel flow rate. Accordingly, it will be appreciated that an increase or decrease in temperature in heat zone 18 will result in a corresponding increase or decrease in the rate of fuel flow through line 62 as controlled by valve 66, and that the change in fuel flow rate will result in a corresponding change in the air flow rate as a result of varying the fuel flow rate signal from function generator 78 to fuel-air ratio controller 84. Likewise, it will be appreciated that the fuel flow rate output signal from function generator 78 through line 80 to temperature-fuel flow comparator 60 will vary in accordance with a change in temperature in heat zone 18.

As further mentioned hereinabove, it has been established that, for a given throughput rate and the corresponding rate of fuel input to the heating zone, there is a positive relationship between the exhaust gas temperature and the rate of fuel input to the heating zone. In accordance with the present invention, these relationships are employed to control the rate of fuel flow to burner 22 in the preheat zone and thus the temperature profile thereacross. In this respect, for the given throughput rate, the temperature of the exhaust gas to provide the desired temperature profile across the preheat and heat zones is known. Accordingly, the signal representative of exhaust gas temperature transmitted from temperature function generator 56 through line 58 to temperature-fuel flow comparator 60 is compared in comparator 60 with the signal representative of the rate of fuel flow to heat zone 18. If the exhaust gas temperature signal indicates an exhaust gas temperature other than that corresponding to the fuel flow rate to burner 24 in the heat zone, comparator 60 produces an output control signal which is operable to control fuel flow control valve 34 so as to increase or decrease the rate of fuel flow to burner 22 in preheat zone 16. In a manner similar to that described with regard to heat zone 18, a variation in the rate of fuel flow in fuel line 30 to burner 22 changes the fuel flow signal to fuel-air ratio controller 48, thereby producing an output signal therefrom to air flow control valve 36 to adjust the latter to provide the appropriate air flow rate for burner 22.

From the foregoing description of the control system illustrated in FIG. 1 it will be appreciated that, at a given throughput rate for workpieces, the control system operates to maintain fuel flow rates to burners 22 and 24 to provide the desired temperature profile across the preheat and heat zones as discussed in greater detail hereinafter. In the event of an increase in the throughput rate from such a given rate, the increase results in the workpieces entering heat zone 18 from preheat zone 16 being at a lower temperature than they would be at the given throughput rate. Accordingly, the temperature in heat zone 18 will drop, and the temperature drop will be sensed by thermocouple 92. This temperature drop will produce a change in the output signal from temperature signal responsive controller 98 which will actuate fuel flow control valve 66 to increase the rate of fuel flow to burner 24. As described hereinabove, the increased rate of fuel flow will result in an adjustment of air flow control valve 68 to provide the appropriate fuel-air ratio in heat zone 18. The increased fuel flow rate will also change the fuel flow rate signal comparator 60, thus in effect resetting the control point therein with respect to the exhaust gas temperature signal, whereupon the comparator produces an output signal resulting in adjustment of fuel flow valve 34 to increase the rate of fuel flow to preheat zone burner 22. Again, as described hereinabove, the increase in the latter fuel flow rate results in a change in the air flow rate to burner 22 to provide the appropriate fuel-air ratio for the burner.

It will be appreciated that the increase in throughput rate also results in cold work being introduced into preheat zone 16 at a faster rate. Accordingly, the exhaust gases sweeping across the cold workpieces produce a decrease in the exhaust gas temperature. This decrease is sensed by thermocouple 54 which thus, in effect, anticipates the increased throughput rate. This decrease in exhaust gas temperature changes the temperature input signal to comparator 60 and, therefore, is capable of resetting the control point in comparator 60 independent of the fuel flow signal thereto. This anticipating capability is of particular importance in connection with a sudden start up of the furnace following a delay period. In this respect, exhaust gases sweeping over the cold workpieces entering the preheat zone reduces the exhaust gas temperature before the workpieces enter heat zone 18, and the resulting change in the exhaust gas signal to comparator 60 produces an output signal from the comparator to adjust fuel flow control valve 34 to increase the fuel flow rate to burner 22, independent of a temperature change in heat zone 18 resulting in a change in the fuel flow rate signal to the comparator. Eventually, upon such a sudden start up, colder workpieces entering heat zone 18 will result in an increase in the rate of fuel flow to burner 24 in the manner described hereinabove and a change in the fuel flow rate signal to comparator 60. In either event, namely an increase in throughput rate from a given throughput rate at which the furnace is being operated or a sudden start up following a delay period, when the fuel flow rate to heat zone 18 adjusts to that known for the throughput rate at which the furnace is being operated following such increase or start up, the control point for comparator 60 is established through the fuel flow rate for burner 24. Thereafter, the rate of fuel flow to burner 22 in preheat zone 16 will adjust to that flow rate required for the exhaust gas temperature to reach the level corresponding to the new throughput rate as determined by the rate of fuel flow to heat zone burner 24. At that time, the exhaust gas temperature signal to comparator 60 will reach the control point established by the fuel flow rate signal, whereby the output signal from comparator 60 will maintain fuel flow control valve 34 in the position providing the necessary fuel flow rate to preheat zone burner 22.

It will be appreciated from the foregoing description of the operation of the control system in response to an increase in throughput rate, that the system operates in a similar manner in response to a decrease from a given throughput rate. Briefly in this respect, a decrease in throughput rate results in an increase in the temperature in heat zone 18 as a result of the countercurrent flow of gases from soak zone 20 into heat zone 18 and the movement of hotter workpieces into the heat zone from preheat zone 16. The temperature increase in heat zone 18 is sensed by thermocouple 92, thus producing a change in the output signal from temperature signal responsive controller 98 which causes an adjustment of fuel flow control valve 66 to reduce the rate of fuel flow to burner 24. The reduction in fuel flow rate results in an adjustment of the air flow rate to burner 24, as will be understood from the description hereinbefore, and causes a change in the fuel flow rate signal from flow rate function generator 78 to comparator 60. The new fuel flow rate signal to comparator 60 resets the control point of the comparator with respect to the exhaust gas temperature signal, thereby producing an output signal to fuel control valve 34 which results in adjustment thereof to reduce the rate of fuel flow to burner 22 for preheat zone 16. As a result of the lower firing rate for the preheat zone, the temperature therein will decrease, thus reducing the temperature of the exhaust gases and, at the temperature level corresponding to the new rate of fuel flow to burner 24, the exhaust gas temperature signal to comparator 60 will operate in conjunction with the fuel flow input signal to provide an output signal which will maintain fuel flow valve 34 at the position providing the rate of fuel flow to burner 22 which provides the desired exhaust gas temperature.

In a manner similar to that described hereinabove in connection with anticipating an increase in throughput rate, thermocouple 54 is operable to anticipate a decrease in throughput rate. In this respect, the increase in temperature in preheat zone 16 and heat zone 18 resulting from the slower movement of workpieces therethrough, together with the cumulative effect of the countercurrent flow of exhaust gases from soak zone 20, heat zone 18 and preheat zone 16 to exhaust stack 28 will quickly increase the temperature of the exhaust gases. This increase is sensed by thermocouple 54 resulting in a change in the exhaust gas temperature signal transmitted to comparator 60, thus to change the control point in the comparator independent of the fuel flow rate signal for burner 24 in heat zone 18. Such a change in the exhaust gas temperature signal produces a change in the output signal of comparator 60 to adjust fuel flow control valve 34 to decrease the rate of fuel flow to preheat zone burner 22. As with the operation of the system in connection with an increase in throughput rate, when fuel flow control valve 66 is adjusted to the required fuel flow rate to burner 24 for the new lower throughput rate, and which fuel flow rate is adjusted in accordance with the temperature in heat zone 18, the control point for comparator 60 is established, and the adjustment of fuel flow control valve 34 for burner 22 will continue until such time as the exhaust gas temperature reaches the level corresponding to the new lower throughput rate. At this time, the exhaust gas temperature signal to comparator 60 will operate in conjunction with the fuel flow rate input signal for burner 24 to produce an output signal which will maintain fuel flow control valve 34 in the position providing the fuel flow rate to burner 22 to maintain the exhaust gas temperature at the level corresponding to the new throughput rate. It will be appreciated, of course, that the adjustment of the rate of fuel flow to burner 22 is accompanied by an adjustment in the rate of air flow thereto in the manner described hereinabove.

With further reference to FIG. 1, preheat zone 16 is preferably provided with a temperature sensor 100, such as a thermocouple, for sensing the temperature in the preheat zone. The output of thermocouple 100 is transmitted to a temperature function generator 102 having an output signal representative of preheat zone temperature and which is transmitted to a temperature signal responsive controller 104. Temperature signal responsive controller 104 produces an output signal which is transmitted to comparator 60 and which can be used in a number of different ways to provide a safety factor in connection with operation of the control system. In this respect, for example, the control signal can be used to provide an override for comparator 60 operable in response to an undesirably high temperature level in the preheat zone. In such use, the control signal would operate to provide an output signal from the comparator which would decrease or shut off fuel flow to burner 22 independent of the exhaust gas and/or fuel flow rate signals to the comparator. As another example, the signal from controller 104 could be used as an override for comparator 60 in the event conditions in the preheat zone indicate a violent or otherwise undesirable deviation in preheat zone temperature. At the same time, however, it will be appreciated that temperature sensor 100 and the advantageous safety functions which can be achieved therewith are not essential with respect to operation of the control system in accordance with the present invention.

With further regard to FIG. 1, it will be noted that soak zone burner 26 is provided with fuel and air supply lines 106 and 108, respectively, and that the soak zone is provided with a temperature sensor 110, such as a thermocouple. The temperature in soak zone 20 is controlled independent of the control system described hereinabove with regard to the preheat and heat zones, and in accordance with the soak zone temperature as sensed by thermocouple 110. While the control arrangement for soak zone 20 is not illustrated in FIG. 1, it will be appreciated that the arrangement can correspond to that provided for heat zone 18 in connection with controlling the supply of fuel and air to heat zone burner 24. In this respect, the control arrangement for soak zone 20 would include fuel and air flow control valves in lines 106 and 108 corresponding to valves 66 and 68, and flow measuring instruments in lines 106 and 108 corresponding to orifice plates 70 and 74 and differential pressure transmitters 72 and 76. Likewise, the latter pressure transmitters would have output signals to function generators corresponding to function generators 78 and 86 and which function generators would have outputs to a fuel-air ratio controller for the air flow control valve corresponding to controller 84. Finally, thermocouple 110 would be operable through a function generator and temperature signal responsive controller corresponding to function generator 94 and controller 98, and which temperature signal responsive controller would control adjustment of the fuel flow control valve for soak zone burner 26. From the foregoing description of the control of fuel and air to burner 24 of heat zone 18, it will be appreciated that the control arrangement for soak zone 20 would operate to control the rates of fuel and air supplied to burner 26 in accordance with the temperature sensed by thermocouple 110 to enable maintaining the soak zone at a desired temperature.

Figure 2:
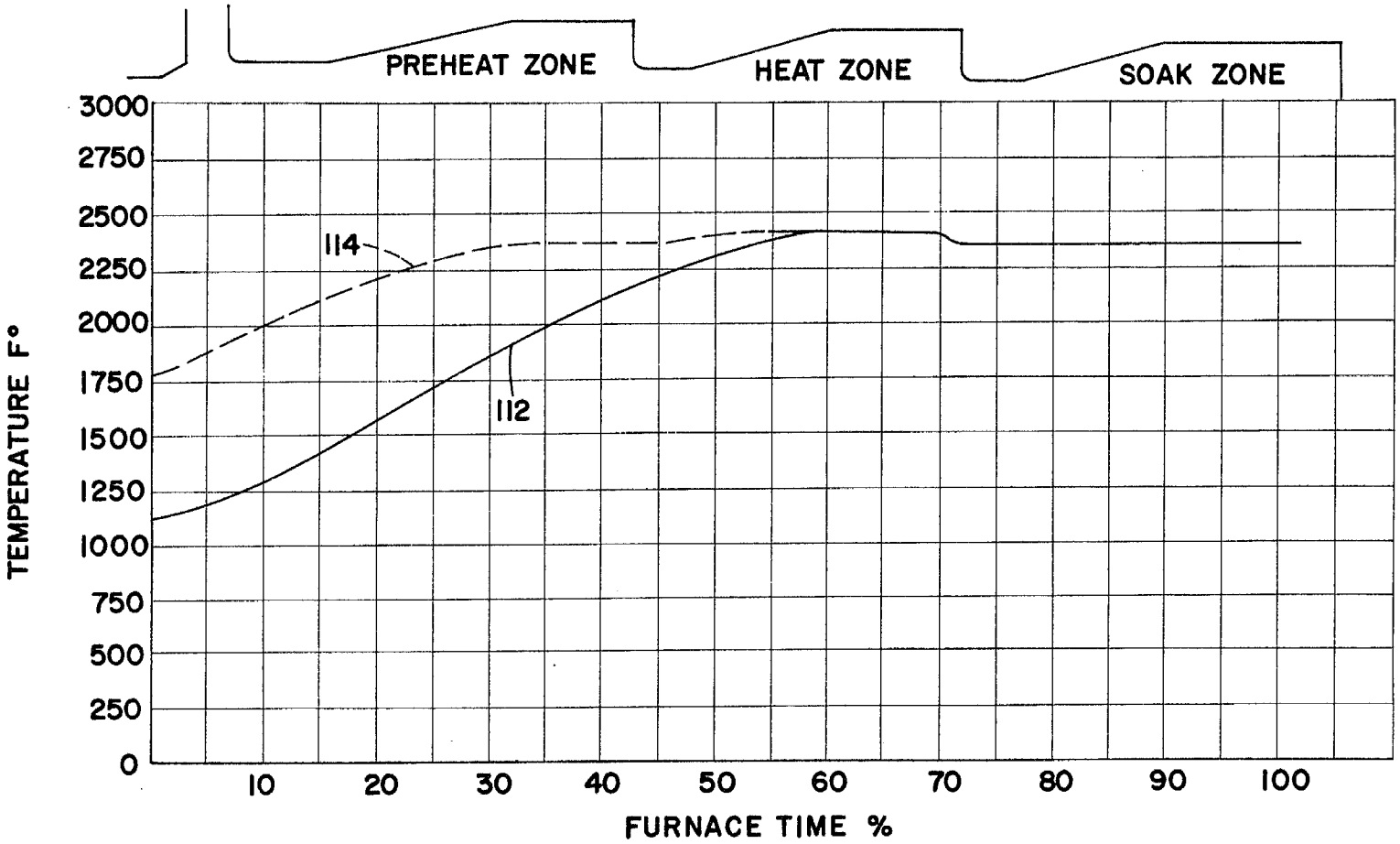
FIG. 2 is a graph illustrating the furnace temperature profile achieved in accordance with the present invention in comparison with the temperature profile generally achieved in connection with reheat furnace operation.
Figure 3:
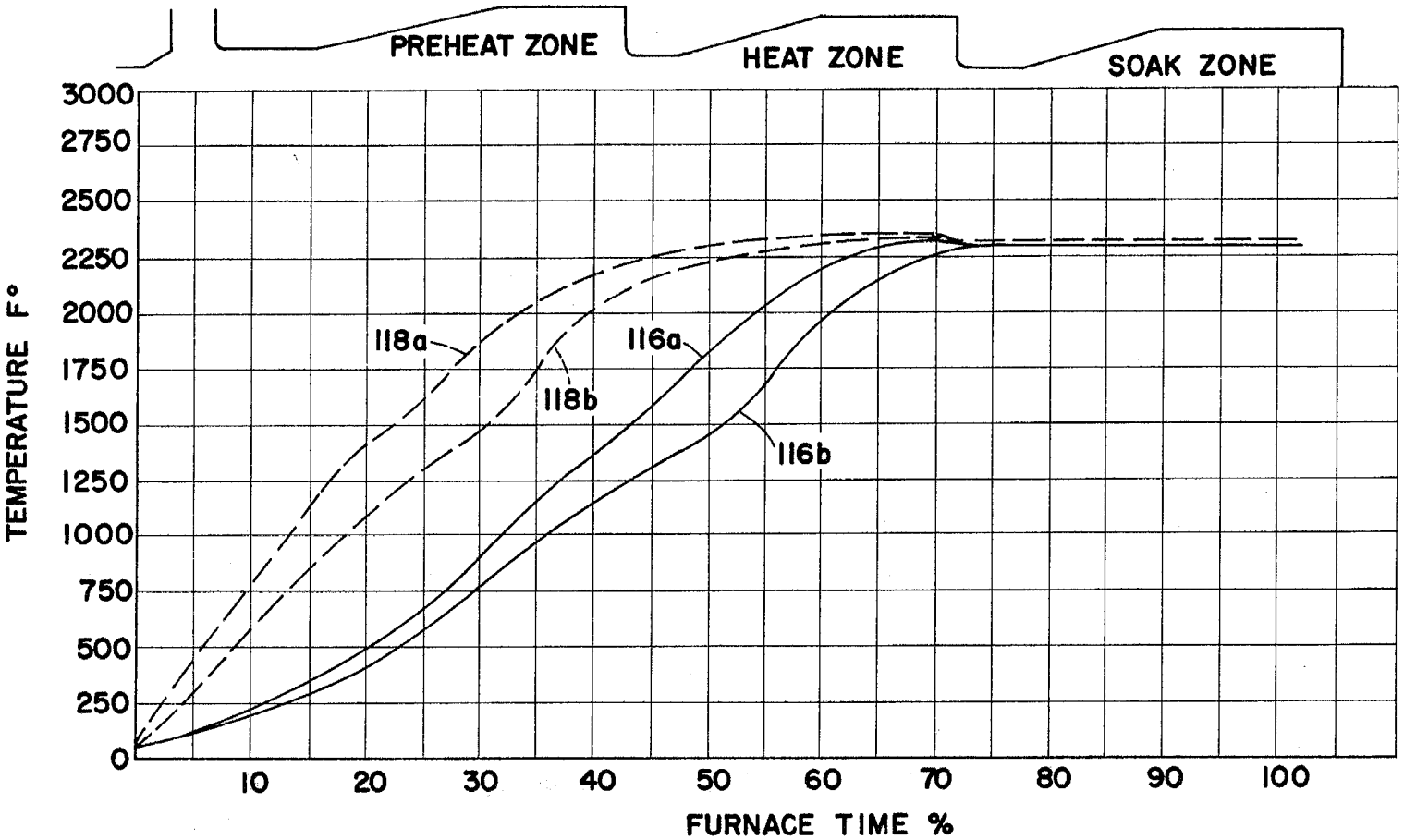
FIG. 3 is a comparative graph similar to FIG. 2 but illustrating the workpiece temperature profile; and, FIG. 4 is a graph illustrating ratios of heating zone fuel flow to preheating zone fuel flow which provides desired furnace temperature profiles in accordance with the invention, and the exhaust gas temperature corresponding to operation of the furnace with the various fuel flow ratios.

The advantages achieved in accordance with the present invention by controlling a multi-zone reheat furnace in the manner described hereinabove will be better appreciated with reference to FIGS. 2 and 3 of the drawing. The latter Figures respectively show a furnace temperature profile and a workpiece temperature profile achieved with the method and system according to the present invention in comparison with corresponding profiles normally achieved with previous methods and control systems. The graphs in FIGS. 2 and 3 are representative of such profiles for a 250 ton reheat furnace operated at 170 tons per hour, or 68% of rated capacity. With reference first to FIG. 2, the temperature profile through the furnace achieved by controlling the furnace according to the present invention is represented by line 112 and the temperature profile normally achieved is represented by line 114. It is readily apparent from FIG. 2 that furnace control according to the present invention provides a substantially lower temperature profile through the preheat zone and a lower profile well into the heat zone while providing the desired profile through the remainder of the heat zone and through the soak zone. It will be appreciated that the lower temperature profile is representative of a considerable savings in fuel consumption and a considerable reduction in exhaust gas temperature and thus thermal loss from the furnace. With regard to fuel consumption, a furnace heretofore requiring 2,000,000 BTU per ton when operating at 80% capacity requires, at the same capacity, only 1,500,000 BTU per ton, thus providing a 25% savings in fuel costs. Furthermore, as the percentage of capacity of operation is reduced, the percentage of savings in fuel consumption increases.

With further regard to FIG. 2, it will be seen that the temperature profile achieved in accordance with the present invention provides for the temperature through the preheat zone to gradually increase therethrough and to continue to increase during movement into the heat zone, whereas the normal temperature profile provides for the temperature to reach a high plateau at about 30% of the furnace time for the workpieces and to remain at the high level through the remainder of the preheat zone. The latter characteristic of the temperature profile is indicative of fast heating of the workpieces and thus the potential loss of quality workpieces due to scaling or oxidation. The profile achieved in accordance with the present invention advantageously minimizes or eliminates this potential loss.

It is of course well known that the purpose of a preheat furnace is to elevate the temperature of workpieces from substantially room temperature to a soaking or process temperature and, ideally, to maintain the workpieces being heated at the process temperature for a minimum period of time. That such heating of workpieces is achieved as a result of furnace control in accordance with the present invention is further evidenced by the graph of FIG. 3. In this respect, lines 116*a* and 116*b* in FIG. 3 respectively show the surface and core temperatures of workpieces heated in the furnace when controlled in accordance with the present invention, and lines 118*a* and 118*b* respectively illustrate the surface and core temperatures of workpieces heated in the furnace using previous furnace control arrangements. It will be appreciated from FIG. 3 that furnace control in accordance with the present invention provides substantially lower temperature profiles for workpieces both through the preheat and heat zones of the furnace with elevation of the surface and core temperatures to the soak temperature upon entrance of the workpieces into the soak zone. Additionally, it will be appreciated from FIG. 3 that the temperature profiles represented by lines 118*a* and 118*b* are indicative of the fact that the soak or process temperature for the workpieces is substantially reached in the preheat zone and is reached early with respect to movement through the heat zone, whereby the workpieces are not only quickly elevated to the process temperature but are maintained substantially at the process temperature for nearly 50% of their time in the furnace. Thus, the graph of FIG. 3 is further illustrative of the potential loss of saleable product through scaling or oxidation as a result of the fast elevating of workpieces substantially to the process temperature and the prolonged furnace time during which the workpieces are maintained at or substantially at the process temperature.

FIG. 4 of the drawing shows a fuel flow rate comparison between the heat and preheat zones of a multi-zone preheat furnace, and the relationship between the flow rate for the heat zone and the exhaust gas temperature which provides the basis for operation of the furnace control illustrated in FIG. 1 and which provides for obtaining the furnace temperature profile 112 shown in FIG. 2. As mentioned herein, the rate of fuel flow to heat zone burner 24 corresponding to a given throughput rate for workpieces is known, and the temperature sensor in heat zone 18 and temperature signal responsive controller 98 are operable to control fuel flow valve 66 to maintain the desired temperature in the heat zone for the given throughput rate. Referring to FIG. 4 with this in mind and presuming, for example, that the given throughput rate requires a rate of fuel flow to burner 24 which represents 70% of the total flow capacity thereof, the desired furnace temperature profile across the preheat and heat zones, based on the relationship between exhaust gas temperature and fuel flow rate to the heat zone, requires an exhaust gas temperature of about 1400° F. This fuel flow rate to heat zone 18 and the exhaust temperature required in connection therewith to achieve the desired temperature profile provide for preheat zone 16 to be heated with a fuel flow rate to burner 22 of 50% of the flow rate capacity thereof.

It will be appreciated from the foregoing description of the embodiment illustrated in the drawing that the controlling of the heating of a fuel fired reheat furnace in accordance with the present invention basically comprises measuring the fuel flow rate for heating the heat zone of the furnace in connection with a given throughput rate, and which fuel flow rate is a function of such given throughput rate, establishing a minimum exhaust gas temperature which, for the given throughput rate and the corresponding fuel flow rate, provides a desired temperature profile across the preheat and heat zones of the furnace, and controlling heating of the preheat zone to obtain the established exhaust gas temperature. It will be further appreciated that control of the furnace in this respect can be achieved manually as opposed to automatically through the operation of a control system such as that illustrated herein. In this respect, for example, a chart indicating the exhaust gas temperatures to be maintained in connection with different fuel flow rates to the burner in the heat zone can be used by an operator to manually adjust firing of the preheat chamber to obtain and maintain a desired exhaust gas temperature based on the operator's visual observation of the fuel flow rate to the heat chamber at any given time and the actual exhaust gas temperature at such given time.

While considerable emphasis has been placed on the control system illustrated in the accompanying drawings, it will be appreciated that the desired control functions in connection with controlling a reheat furnace in accordance with the present invention can readily be achieved with other control system arrangements as well as modifications of the system herein illustrated and described. Furthermore, it will be appreciated that adjustments of the fuel and air flow control valves for the preheat and heat zones could be made manually based on visual readings of instruments representing flow rates and heat zone and exhaust gas temperatures. Accordingly, it is to be distinctly understood that the foregoing descriptive matter is to be interpreted merely as illustrative of the present invention and not as a limitation.

Having thus described the invention, it is claimed:

1. A method of controlling a fuel fired reheat furnace having input and discharge ends, a preheat zone near said input end, a heat zone between said preheat zone and said discharge end, fuel burner means in each said preheat and heat zones and exhaust gas fuel means between said input end and said preheat zone, said method comprising measuring the fuel flow rate for heating said heat zone as a function of a given throughput rate for said furnace, establishing an exhaust gas temperature corresponding to said flow rate as a further function for said given throughput rate, and controlling heating of said preheat zone to obtain said established exhaust gas temperature.

2. The method according to claim 1, and controlling heating of said preheat zone by controlling the fuel flow rate to the fuel burner means thereof.

3. The method according to claim 1, and measuring the exhaust gas temperature of said furnace, and varying heating of said preheat zone in accordance with a difference between said measured temperature and said established temperature.

4. The method according to claim 1, and producing first and second control signals respectively representative of said fuel flow rate for heating said heat zone and the actual exhaust gas temperature of said furnace, comparing said first and second control signals to provide a third signal indicative of a difference between said actual exhaust gas temperature and said established exhaust gas temperature, and controlling heating of said preheat zone in accordance with said third signal.

5. The method according to claim 4, and varying the fuel flow rate to the fuel burner means in said preheat zone in accordance with said third signal.

6. A heating control system for a reheat furnace having input and discharge ends, a preheat zone near said input end, a heat zone between said preheat zone and said discharge end, fuel burner means in each said preheat and heat zones, means for supplying fuel to each said burner means, and exhaust gas flue means between said input end and said preheat zone, said control system including means for producing a first control signal representing fuel flow to said fuel burner means in said heat zone, means for producing a second control signal representing the temperature of exhaust gas, means for comparing said first and second control signals and providing an output signal, and means responsive to said output signal for controlling fuel flow to said burner means in said preheat zone.

7. The control system according to claim 6, wherein said means for producing said second control signal includes means to measure said exhaust gas temperature.

8. The control system according to claim 6, wherein said means for supplying fuel to each said burner means includes corresponding fuel flow control valve means, means to measure the temperature in said heat zone, and means responsive to said last named means to control said valve means for said burner means in said heat zone in accordance with the temperature measured in said heat zone.

9. The control system according to claim 8, and controlling heating of said preheat zone by controlling the fuel flow rate to the fuel burner means thereof.

10. The control system according to claim 9, wherein said means responsive to said output signal is said flow control valve means for said burner means in said preheat zone.

* * * * *